US005406021A

United States Patent [19]

Koike

[11] Patent Number: 5,406,021

[45] Date of Patent: Apr. 11, 1995

[54] ELECTRONIC MUSICAL INSTRUMENT WHICH PREVENTS TONE GENERATION FOR PARTIAL KEYSTROKES

[75] Inventor: Tatsuhiro Koike, Hamamatsu, Japan

[73] Assignee: Yamaha Corporation, Japan

[21] Appl. No.: 89,796

[22] Filed: Jul. 9, 1993

[30] Foreign Application Priority Data

Jul. 17, 1992 [JP] Japan ..... 4-191084

[51] Int. Cl.[6] ..... G10H 1/18

[52] U.S. Cl. ..... 84/615; 84/626; 84/658; 84/DIG. 7

[58] Field of Search ..... 84/615, 626, 658, 687-690, 84/21, 22, DIG. 7

[56] References Cited

U.S. PATENT DOCUMENTS 5,138,926 8/1992 Stier et al. ..... 84/615

FOREIGN PATENT DOCUMENTS 4-52693 2/1992 Japan .

*Primary Examiner*—Stanley J. Witkowski
*Attorney, Agent, or Firm*—Graham & James

[57] ABSTRACT

An electronic musical instrument employing a keyboard unit provides a position sensor with respect to each of plural keys so as to detect a depressed position of the key in a real-time manner. A key-operating velocity is calculated from the depressed positions of the key which are sequentially detected by the position sensor. A critical velocity is determined in advance with respect to each of the depressed positions of the key. The critical velocity is defined as a minimum velocity by which a hammer can strike a string when a hammer moves from a position corresponding to each of the depressed positions of the key. One of the channels is selected in accordance with a predetermined algorithm on the basis of a result of a judging operation which judges whether or not the key-operating velocity exceeds the critical velocity corresponding to a current depressed position of the key. Then, a tone-generation task to produce a musical tone signal responsive to a key-operation event is assigned to a selected channel. On the basis of the key-operating velocity and the result of the judging operation, a start timing to produce the musical tone signal is designated for the selected channel. Thus, the selected channel produces the musical tone signal at the designated start timing.

7 Claims, 7 Drawing Sheets

FIG.2 (MAIN ROUTINE)

ELECTRONIC MUSICAL INSTRUMENT WHICH PREVENTS TONE GENERATION FOR PARTIAL KEYSTROKES

BACKGROUND OF THE INVENTION

1. Field of the Invention

The present invention relates to an electronic musical instrument providing a plurality of channels from which musical tones are produced.

2. Prior Art

The keyboard employed in the conventional electronic musical instrument can be classified into the following two types.

(1) First type of keyboard: a simple on/off switch is provided for each of the keys, so that an on/off event of each key is detected.

(2) Second type of keyboard: a change-over-type switch is provided for each of the keys, wherein this switch consists of a movable contact, first and second fixed contacts. Herein, a time required for performing a switching operation in which the movable contact is moved from the first fixed contact to the second fixed contact is measured, so that an average operating velocity (or an average depressing velocity) of the key is computed on the basis of the result of the measurement.

In the second type of keyboard, a tone volume and/or a tone color for the musical tone is controlled on the basis of the computed average operating velocity of the key, for example.

In general, an electronic musical instrument recently developed provides a plurality of channels for the production of the musical tones. This electronic musical instrument is designed such that when detecting the key-depression events of the keys which are simultaneously depressed, plural musical tones can be simultaneously produced in a polyphonic sounding manner.

Some of the electronic musical instruments each providing the second type of keyboard are designed as described above so that plural musical tones can be simultaneously produced. In such electronic musical instrument, the musical note corresponding to a key newly depressed is assigned to one of the channels after computing the average operating velocity of the key. Therefore, it takes much time to produce the musical tone after depressing the key. Particularly, in the case of the electronic musical instrument having a limited number of channels, if all of the channels are occupied in producing the musical tones, one of the channels of which musical tone is attenuated and its tone volume is the smallest is selected, so that a musical note corresponding to a newly depressed key is assigned to the selected channel. This process is called a truncate process. Since the truncate process is required in the conventional electronic musical instrument, it takes more time to actually produce the musical tone after depressing the key.

In order to solve the above-mentioned problem, the present applicant has proposed a new electronic musical instrument, of which technical features are disclosed in Japanese Patent Laid-Open Publication No. 4-52693. This electronic musical instrument provides the aforementioned second type of keyboard, and it is designed such that a musical note corresponding to a newly depressed key is assigned to a predetermined one of the channels when detecting an event in which the movable contact comes in contact with the first fixed contact in the newly depressed key. Thus, it is possible to reduce a time lag which is occurred when the musical tone is actually produced after depressing the key.

Meanwhile, in the case of the string-striking type instrument such as the piano, when the key is depressed so that key is rotated down about a predetermined fulcrum point, the rotating motion of the key is transmitted toward a hammer by means of a string-striking mechanism, so that the hammer is rotated by the inertia, and consequently, a string-striking operation is achieved. Due to the above-mentioned structure of the instrument, if the performer slowly and slightly depresses the key, the hammer is not rotated sufficiently, so that the hammer is returned back to its original position without actually striking the string, resulting that the musical tone is not produced.

However, in the conventional electronic musical instruments described before, even if the performer makes every effort to slowly and slightly depress the key so that the musical tone will not be actually produced, the musical tone must be actually and eventually produced. More specifically, in the case of the electronic musical instrument providing the first type of keyboard, the switch equipped with the key must be turned on even if the performer slightly depresses the key, resulting that the musical tone must be actually produced. In the case of another electronic musical instrument providing the second type of keyboard, even if the performer slowly depresses the key, the time which is required for the movable contact of the change-over-type switch to move from the first fixed contact to the second fixed contact must be measured so that the average operating velocity of the key is computed on the basis of the result of the measurement, resulting that the musical tone must be actually produced by a small tone volume corresponding to the computed average operating velocity of the key.

Thus, the conventional electronic musical instrument suffers from a drawback in that even if the performer stops depressing the key in the middle of the key-depressing motion or the performer unintentionally touches a key adjacent to the key to be depressed by mistake, the musical tone which is not intentionally designated by the performer must be eventually produced.

Moreover, in the foregoing electronic musical instrument as disclosed in the foregoing Japanese patent laid-open publication, the musical tone which is not intentionally designated by the performer as described above must be automatically assigned to the predetermined one of the channels when detecting that the movable contact comes in contact with the first fixed contact. In this case, an assigning operation by which a new musical tone is assigned to one of the channels must be carried out against the will of the performer.

SUMMARY OF THE INVENTION

It is accordingly a primary object of the present invention to provide an electronic musical instrument which can produce the musical tone at a good timing matching with the key-depressing motion without substantially causing any time lag.

According to the present invention, an electronic musical instrument provides a keyboard containing a plurality of keys, a key displacement detecting portion, a key-operating-velocity information creating portion, a judging portion, a musical tone signal producing portion, an assigning portion and a control portion. The key displacement detecting portion detects a displacement applied to each of the keys. On the basis of the detected displacement of the key, the key-operating-velocity information is created. Then, the judging portion judges whether or not the key-operating velocity is larger than a predetermined velocity value. The musical tone signal producing portion provides a plurality of channels each used for producing a musical tone signal. The musical tone signals are produced for these channels respectively. On the basis of the result of the judging operation made by the Judging portion, the assigning portion assigns a task for producing a new musical tone signal to one of the channels. The control portion instructs the musical tone signal producing portion to produce the musical tone signal on the basis of the key-operating velocity and the result of the judging operation with respect to each of the keys depressed by the performer.

Thus, the musical tone signal producing portion starts to produce a new musical tone signal from the channel, selected by the assigning portion, at the timing which is designated by the control portion.

BRIEF DESCRIPTION OF THE DRAWINGS

Further objects and advantages of the present invention will be apparent from the following description, reference being had to the accompanying drawings wherein the preferred embodiment of the present invention is clearly shown.

In the drawings.

DESCRIPTION OF THE PREFERRED EMBODIMENTS

[A] Fundamental Concept

Figure 1:
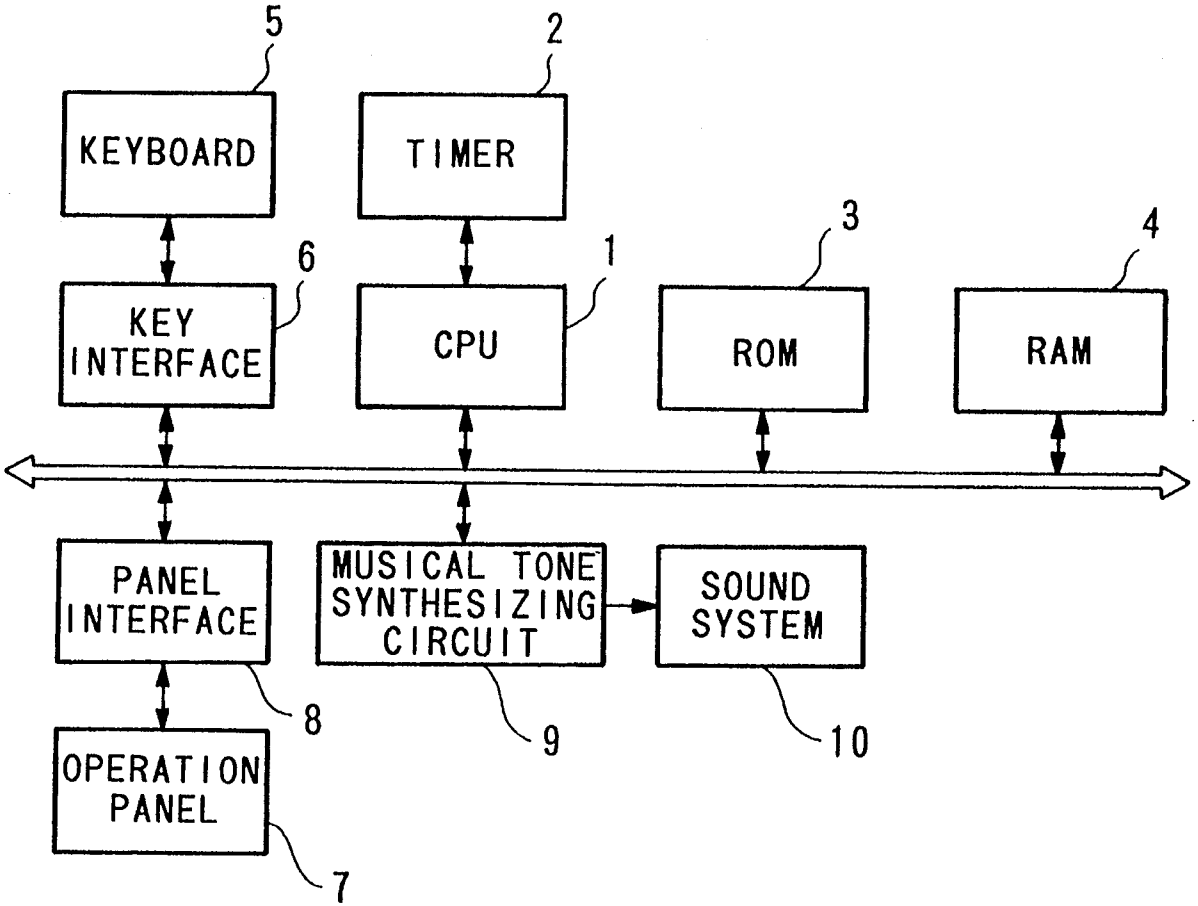
FIG. 1 is a block diagram showing an electronic configuration of an electronic musical instrument according to an embodiment of the present invention.

Before describing an electronic musical instrument according to an embodiment of the present invention in detail, the description will be given with respect to the fundamental concept employed in the present invention by which the aforementioned problems are solved. The electronic musical instrument according to the present invention employs a special-designed keyboard which is different from both of the aforementioned first type of keyboard and the second type of keyboard. This keyboard provides a position sensor with respect to each of the keys, and this position sensor can accurately sense the position of the key which is located at any point within a key stroke when the key is depressed down. For example, the position sensor can be designed by a rotary-type switch by which the position of the key to be. depressed is sensed wherever the key is located within the key stroke. Herein, the key stroke can be defined as the distance by which the key is fully depressed down from its original position. Or, the position sensor can be designed by a selector-type switch in which a plurality of fixed contacts (e.g., eight fixed contacts) are vertically arranged within the key stroke so that when the movable contact attached to the key comes in contact with one of the fixed contacts by depressing the key, the depressed position of the key can be detected by detecting the fixed contact to be contacted with the movable contact. In this case, one of the fixed contact is located at a certain position corresponding to the original position of the key which is not depressed, while another one is located at another position corresponding to the position of the key which is fully depressed down.

The position sensor employing the foregoing rotary-type switch (hereinafter, referred to as an analog position sensor) can continuously detect the position of the key in a real-time manner, so that a position signal representing the position of the key may have an analog value. By performing a differentiation on the analog value with respect to time, the operating velocity of the key is computed. On the other hand, the position sensor employing the selector-type switch (hereinafter, referred to as a digital position sensor) intermittently detects the position of the key, so that a position signal may have a digital value. Herein, a time required for the selector-type switch to move the movable contact from one fixed contact to its adjacent fixed contact while depressing the key is measured, so that the operating velocity of the key is computed on the basis of the result of the measurement of time.

According to the present invention, the position of the key is detected by the analog position sensor (or digital position sensor), and then, the operating velocity of the key is computed. Then, it is judged whether or not the operating velocity of the key which is located at a certain position within the key stroke exceeds the predetermined critical velocity value. On the basis of the result of the judgement, a task for producing a musical tone signal is assigned to one of the channels.

Figure 8:
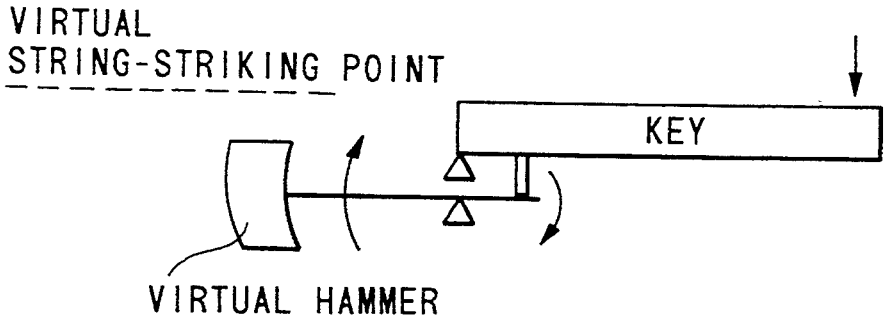
FIG. 8 is a drawing which is used for explaining a fundamental concept of the present invention.

Next, a channel assignment operation will be described in detail. Firstly, a virtual mass is applied to a key of the keyboard, while the operations of the string-striking mechanism and the hammer are virtually simulated as shown in FIG. 8. When the performer depresses down the key so that the key is rotated, a virtual hammer is indirectly driven by means of a virtual string-striking mechanism. When the hammer rotates and the rotating velocity of the hammer exceeds the predetermined velocity value at a certain position within a stroke of the hammer, even if the performer intends to stop depressing the key such that no force will be additionally applied to the hammer, the hammer may certainly reach at a virtual string-striking point under the effect of the inertia of the hammer. At this time when the production of the musical tone is ascertained, the present invention is activated to assign the task for producing the musical tone signal to one of the channels before sending a tone-generation instruction.

Thus, it is possible to avoid the time lag which is occurred when producing the musical tone after depressing the key, and it is also possible to avoid wasting the time required for executing the unnecessary channel assignment operation which is occurred when the performer touches the key by mistake and then stops depressing the key.

Further, the present invention presumes that when the production of the musical tone is ascertained, no additional force is applied to the key. Then, the present invention predicts the operating velocity of the key which reaches at the virtual string-striking point, and it also predicts the time required for the hammer to reach the virtual string-striking point from now. On the basis of the detected position of the key and the predicted operating velocity of the key, the predetermined computation is performed so as to compute a keycode of the key to be depressed and also compute a predicted tone volume and other information representing the period of time (milli-seconds) between the current timing and the time when the musical tone should be actually produced. These are transferred to a musical tone synthesizing circuit.

Thus, it is possible to substantially delete the time lag which is occurred when actually producing the musical tone after depressing the key, and it is also possible to produce the musical tone at a good timing which matches with the timing when the performer operates the key.

[B] Configuration of Embodiment

Next, the description will be given with respect to an electronic musical instrument according to an embodiment of the present invention by referring to the drawings. FIG. 1 is a block diagram showing electronic circuits and the like of the electronic musical instrument according to an embodiment of the present invention. In FIG. 1, a numeral 1 designates a central processing unit (i.e., CPU) which controls several portions of the electronic circuitry, while 2 designates a timer to which time data representing a measured time is set by the CPU 1. Every time a predetermined time designated by the time data is passed, the timer 2 sends a timer interrupt pulse to the CPU 1.

In addition, 3 designates a read-only memory (i.e., ROM) which stores several kinds of control programs (and/or several kinds of data) to be loaded up to the CPU 1, while 4 designates a random-access memory (i.e., RAM) which provides a working buffer memory and the like. 5 designates a keyboard consisting of a plurality of keys each providing with a position sensor. This position sensor detects the depressed position of the key, which is continuously moved when being depressed down and then released, in a real-time manner. Then, a key-depressing velocity and a key-releasing velocity are also detected. Thus, a signal corresponding to the key-depressing velocity or key-releasing velocity is produced with respect to each of the keys which is depressed or released by the performer. 6 designates a key interface which creates key information representing the tone pitch, key-depressing velocity, key-releasing velocity and the like on the basis of several kinds of signals produced from the keyboard 5.

Further, 7 designates an operation panel which contains a display unit made by use of a crystal-liquid display, a ten-key unit, an enter key which is used for changing a display image on a display screen of the display unit, a cursor key which is used for moving a displayed position of a cursor on the display screen of the display unit, and the like. The operation panel 7 displays the contents of data which is supplied thereto from the CPU 1 by means of a panel interface 8. In addition, this operation panel 7 functions to transfer the data corresponding to the state of the key to the CPU 1 via the panel interface 8.

Moreover, 9 designates a musical tone synthesizing circuit which provides a plurality of channels. A musical-tone synthesis is carried out in each of the channels on the basis of several kinds of data outputted from the CPU 1. Therefore, the musical tone synthesizing circuit 9 can output the musical tone signals which are respectively formed in the channels. Finally, 10 designates a sound system which performs a filtering operation on plural musical tone signals outputted from the musical tone synthesizing circuit 9 so as to eliminate an unnecessary noise from the musical tone signal or impart a sound effect to the musical tone signal. Then, the sound system 10 amplifies the musical tone signal so as to actually produce the musical tone.

[C] Operation of Embodiment

Next, the detailed description will be given with respect to the operations of the CPU by referring to the flowcharts shown in FIGS. 2 through 8.

(1) Main Routine

When the power is applied to the electronic musical instrument having the electronic configuration as Shown in FIG. 1, the CPU 1 executes a main routine so that the processing of the CPU 1 enters into a step SA1. In step SA1, several portions of the electronic musical instrument are initialized. More specifically, several kinds of registers are reset so that their values are cleared to zero, while several kinds of initial values are set for peripheral circuits. Then, the processing of the CPU 1 proceeds to step SA2.

In step SA2, a keyboard-operation detecting process is carried out, so that the CPU 1 scans all of the keys of the keyboard 5, which are operated (or performed) by the performer, so as to detect the depressing positions of the keys and store them in the RAM 4. Incidentally, the detailed description of the keyboard-operation detecting process will be given later. After completing this process, the processing of the CPU 1 proceeds to a next step SA3.

In step SA3, a tone-generation assignment process is carried out with respect to the operated key which is detected by the foregoing keyboard-operation detecting process. The details of this tone-generation assignment process will be described later. After completing this process, the processing proceeds to step SA4.

In step SA4, a tone-generation channel process is carried out. As described before, the electronic musical instrument provides a plurality of channels (i.e., tone-generation channels) in the musical tone synthesizing circuit 9. According to the tone-generation channel process, the CPU 1 searches the channel of which tone-volume level is lower than a predetermined level among the channels each occupied with a tone-generation task in the music&l tone synthesizing circuit 9, so that the searched channel is set as an unoccupied channel which is not occupied with the tone-generation task. Then, the processing of the CPU 1 proceeds to step SA5.

In step SA5, an operation panel process is carried out. According to the operation panel process, several musical parameters such as a tune image, a tempo, a performing style and a tone color are set in response to a manual operation which is applied to the operation panel 7 by the performer.

After completing the operation panel process, the processing returns back to the foregoing step SA2. Thus, until the power is cut off, the above-mentioned processes of steps SA2 through SA5 are repeatedly performed. As described heretofore, in the main routine, the CPU 1 sends instructions and commands to the electronic circuits shown in FIG. 1 so as to designate a synthesis of musical tone signals in response to several kinds of events occurred in the keyboard 5 and the operation panel 7, and then, the synthesized musical tone signals are subjected to several kinds of processings which will be described later.

(2) Keyboard-Operation Detecting Process

Next, the keyboard-operation detecting process will be described in detail by referring to the flowchart shown in FIG. 3.

Figure 3:
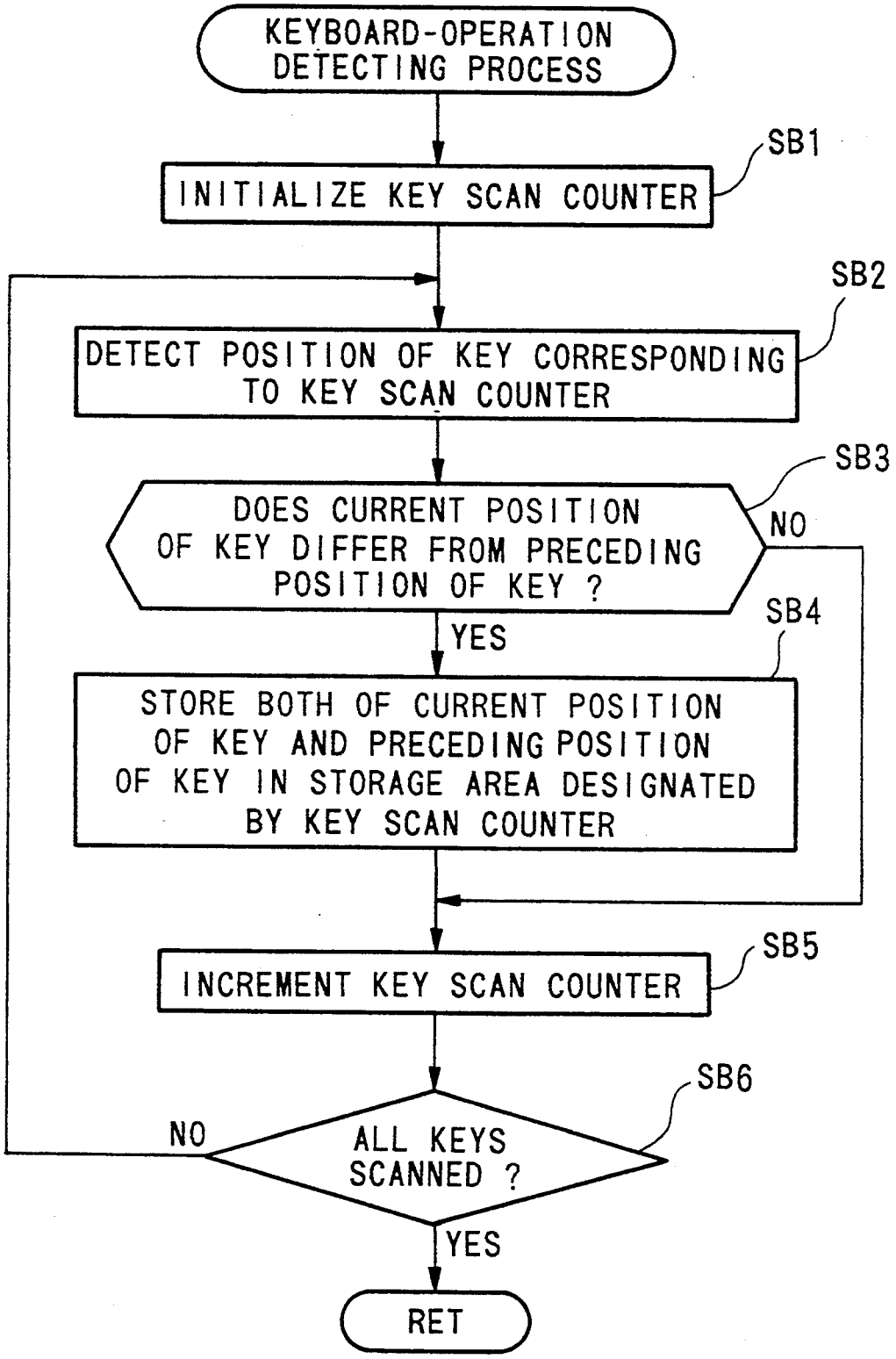
FIG. 3 is a flowchart showing a routine of a keyboard-operation detecting process.

When the processing of the CPU 1 proceeds to the foregoing step SA2, the keyboard-operation detecting process as shown in FIG. 3 is started. In first step SB1 of the keyboard-operation detecting process, a key scan counter which counts up a number until the number becomes equal to the number of the keys provided in the keyboard 5 is initialized in order to scan all of the keys in the keyboard 5. Then, the processing proceeds to step SB2.

In step SB2, the depressed position of the key which corresponds to a count value of the key scan counter is detected on the basis of the output of the aforementioned position sensor attached to that key. Then, the processing proceeds to step SB3.

In the present embodiment, all of the keys are scanned once so as to detect the depressing position with respect to each of the keys in a predetermined scanning cycle. So, when a key is continuously depressed down in a period corresponding to two scanning cycles or more, a currently depressed position of the key (hereinafter, simply referred to as a current position of the key), which is detected in a current scanning cycle, becomes different from a precedingly depressed position of the key (hereinafter, simply referred to as a preceding position of the key), which is detected in a preceding scanning cycle. In step SB3, it is judged whether or not the current position of the key is different from the preceding position of the key with respect to the key which corresponds to the count value of the key scan counter (see step SB2). If the judgement result is "YES", the processing proceeds to step SB4.

In step SB4, data representing both of the current position of the key and the preceding position of the key are stored in a storage area of the RAM 4 which is designated by the count value of the key scan counter. Then, the processing proceeds to step SB5.

In the case where the judgement result of step SB3 is "NO", The key corresponding to the count value of the key scan counter is not depressed by the performer, or that key is depressed but is not fully depressed down because the depressing motion applied to that key is intentionally stopped by the performer. In this case, the current position of the key does not differ from the preceding position of the key, and consequently, the processing jumps from step SB3 to step SB5.

In step SB5, the count value of the key scan counter is incremented by one. Then, the processing proceeds to step SB6.

In step SB6, it is judged whether or not the foregoing processes of step SB2 through SB4 are carried out with respect to all of the keys of the keyboard 5. This judgement operation is carried out by judging whether or not the count value of the key scan counter becomes equal to a predetermined value. If the judgement result of step SB6 is "NO", the processing returns back To step SB2, so that the foregoing processes of steps SB2 through SB5 are repeated.

Figure 2:
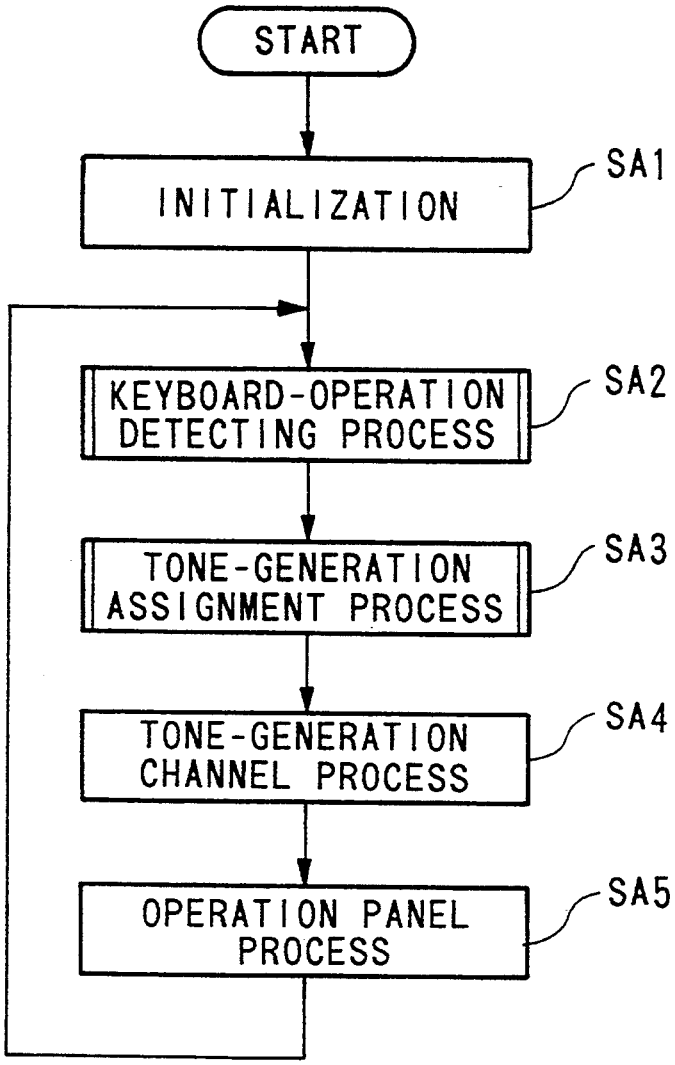
FIG. 2 is a flowchart showing a main routine of an embodiment of the present invention.

On the other hand, if the judgement result of step SB6 is "YES", representing that the foregoing processes of steps SB2 through SB4 are performed with respect to all of the keys of the keyboard 5, the processing of the CPU 1 returns back to the aforementioned main routine shown in FIG. 2 so that the processing proceeds to step SA3.

(3) Tone-Generation Assignment Process

Next, the tone-generation assignment process will be described in detail by referring to the flowchart shown in FIG. 4.

Figure 4:
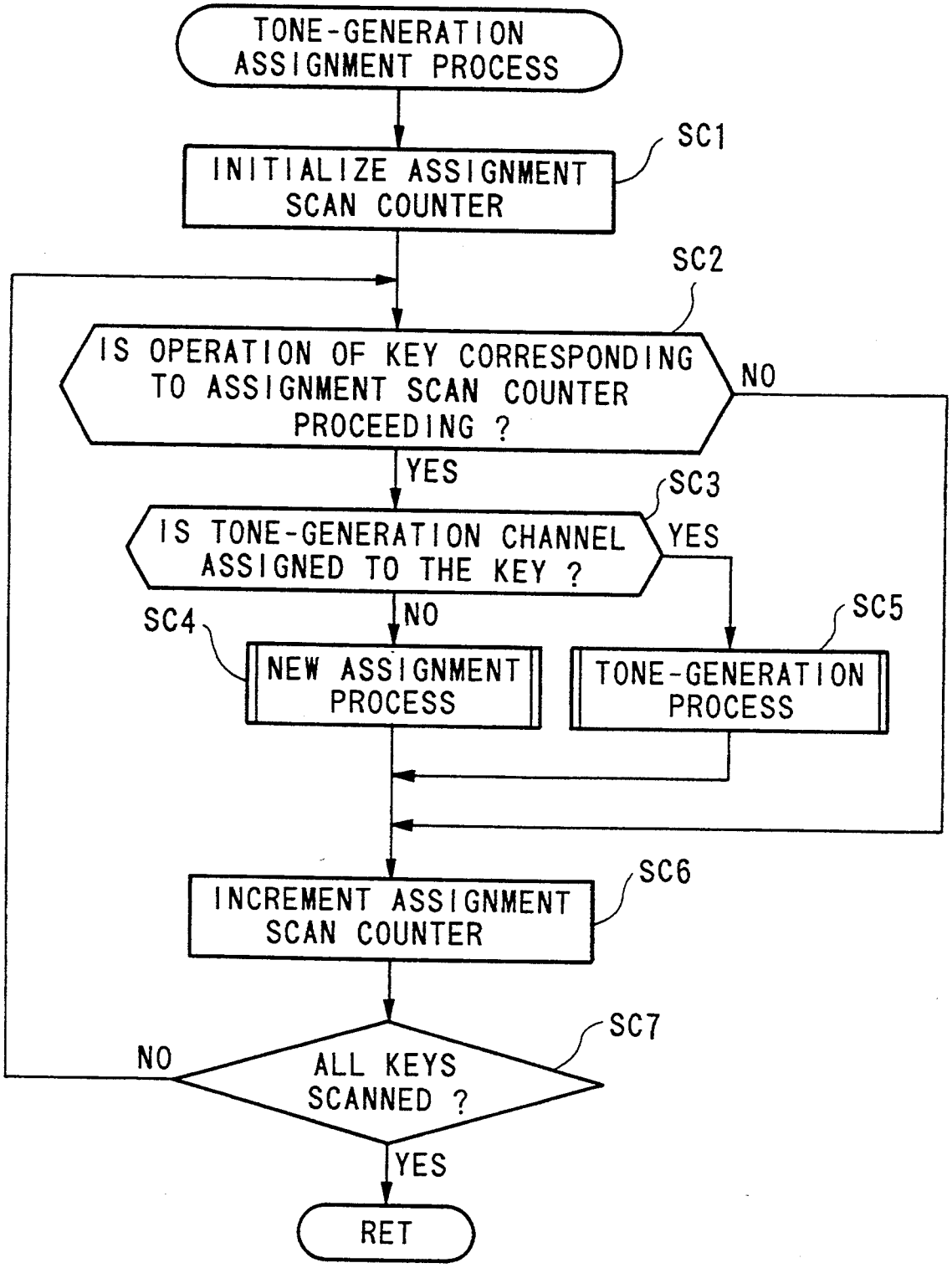
FIG. 4 is a flowchart showing a routine of a tone-generation assignment process.

When the processing of the CPU 1 proceeds to step SA3, the tone-generation assignment process as shown by the flowchart of FIG. 4 is started. In first step SC1, in order to assign tone-generation tasks to the respective channels, the CPU 1 initializes an assignment scan counter which counts up a number until the number becomes equal to the number of the keys provided in the keyboard 5. Then, the processing proceeds to step SC2.

In step SC2, it is judged whether or not the key corresponding to a count value of the assignment scan counter is now operated by the performer. This judging operation is carried out by referring to the foregoing current position of the key and the preceding position of the key which are detected in the foregoing keyboard-operation detecting process as shown in FIG. 3. Herein, the current position of the key is detected in the current scanning cycle, while the preceding position of the key is stored in a predetermined storage area of the RAM 4 in the preceding scanning cycle.

In the case where the key is not operated so that it is located in a key-release position during two scanning cycles, the preceding position of the key which is detected in the preceding scanning cycle is represented by a value "0", and the current position of the key to be detected in the current scanning cycle is also represented by a value "0", for example. The CPU 1 discriminates the operating key from the above-mentioned keys each of which is remained at the key-release position during continuous two scanning cycles among the keys provided in the keyboard 5. In other words, all of the keys which are not remained at the key-release positions during the continuous two scanning cycles are discriminated as the operating keys.

If a certain key is fully depressed down and remained at a fully-depressed position for a while, there is no change between the preceding and, current positions of the key. However, due to the aforementioned discriminating operation of the CPU 1, it is possible to discriminate such key as the operating key.

If the judgement result of step SC2 is "YES", representing that the key corresponding to the count value of the assignment scan counter is discriminated as the operating key, the processing proceeds to step SC3.

In step SC3, it is judged whether or not the CPU 1 assigns a tone-generation task for the key, which is discriminated as the operating key in the foregoing step SC2, to a certain channel. If the judgement result is "NO", the processing proceeds to step SC4.

In step SC4, at a time when a tone-generation event is certainly occurred with respect to the key, a new assignment process is carried out in order to assign the channel for the key. The details of the new assignment process will be described later. When completing the new assignment process, the processing proceeds to step SC6.

In the meantime, if the judgement result of step SC3 is "YES", representing that the certain channel has been already assigned for the key which is discriminated as the operating key in step SC2, the processing Jumps to step SC5.

In step SC5, a tone-generation process is carried out. The details of the tone-generation process will be described later. When completing the tone-generation process, the processing proceeds to step SC6.

In step SC6, the assignment scan counter is incremented by one. Then, the processing proceeds to step SC7.

In step SC7, it is judged whether or not the aforementioned processes of steps SC2 through SC5 are carried out with respect to all of the keys provided in the keyboard 5. This judging operation is carried out by judging whether or not the count value of the assignment scan counter reaches a predetermined value. If the judgement result of step SC7 is "NO", the foregoing processes of steps SC2 through SC6 are repeated.

On the other hand, if the judgement result of step SC7 is "YES", representing that the processes of steps SC2 through SC5 are carried out with respect to all of the keys provided in the keyboard 5, the processing returns back to the main routine as shown in FIG. 2. In the main routine, the processing proceeds to step SA4.

(4) New Assignment Process

Next, the contents of the new assignment process will be described in detail by referring to the flowcharts shown in FIGS. 5 and 6.

Figure 5:
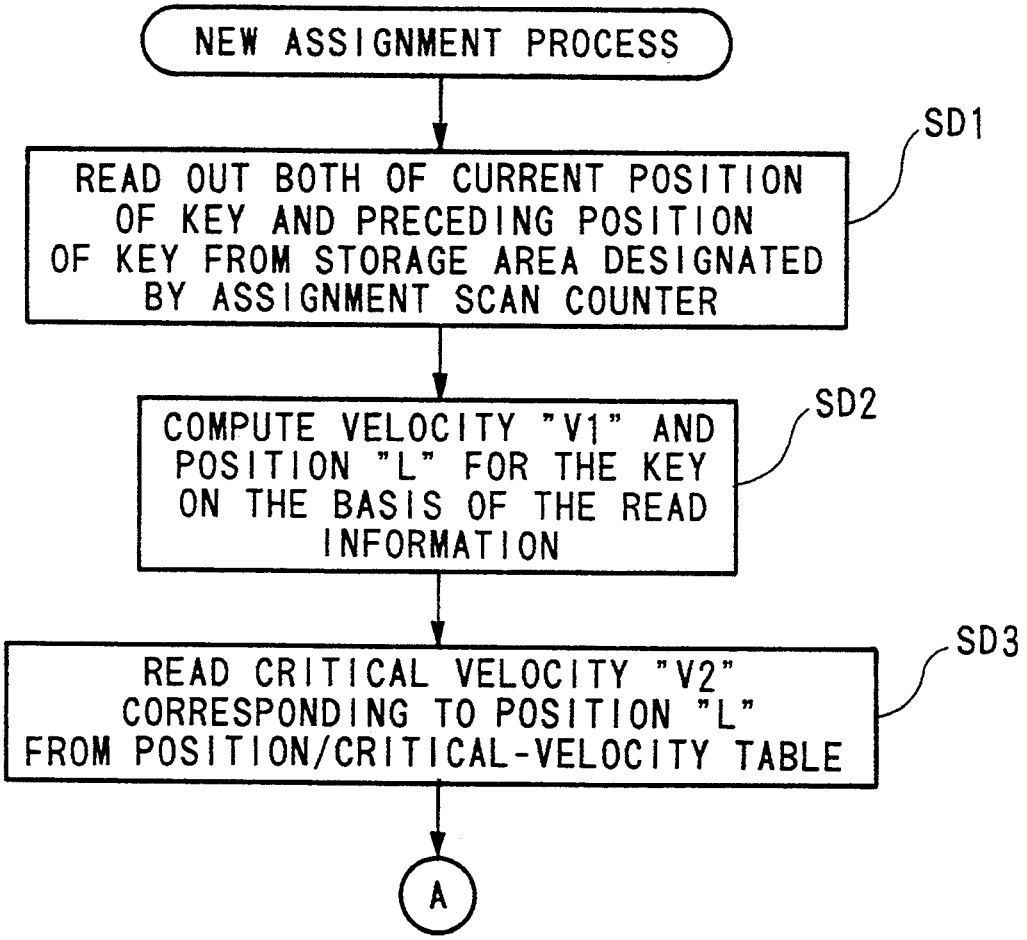
FIGS. 5 and 6 are flowcharts showing a routine of a new assignment process.
Figure 6:
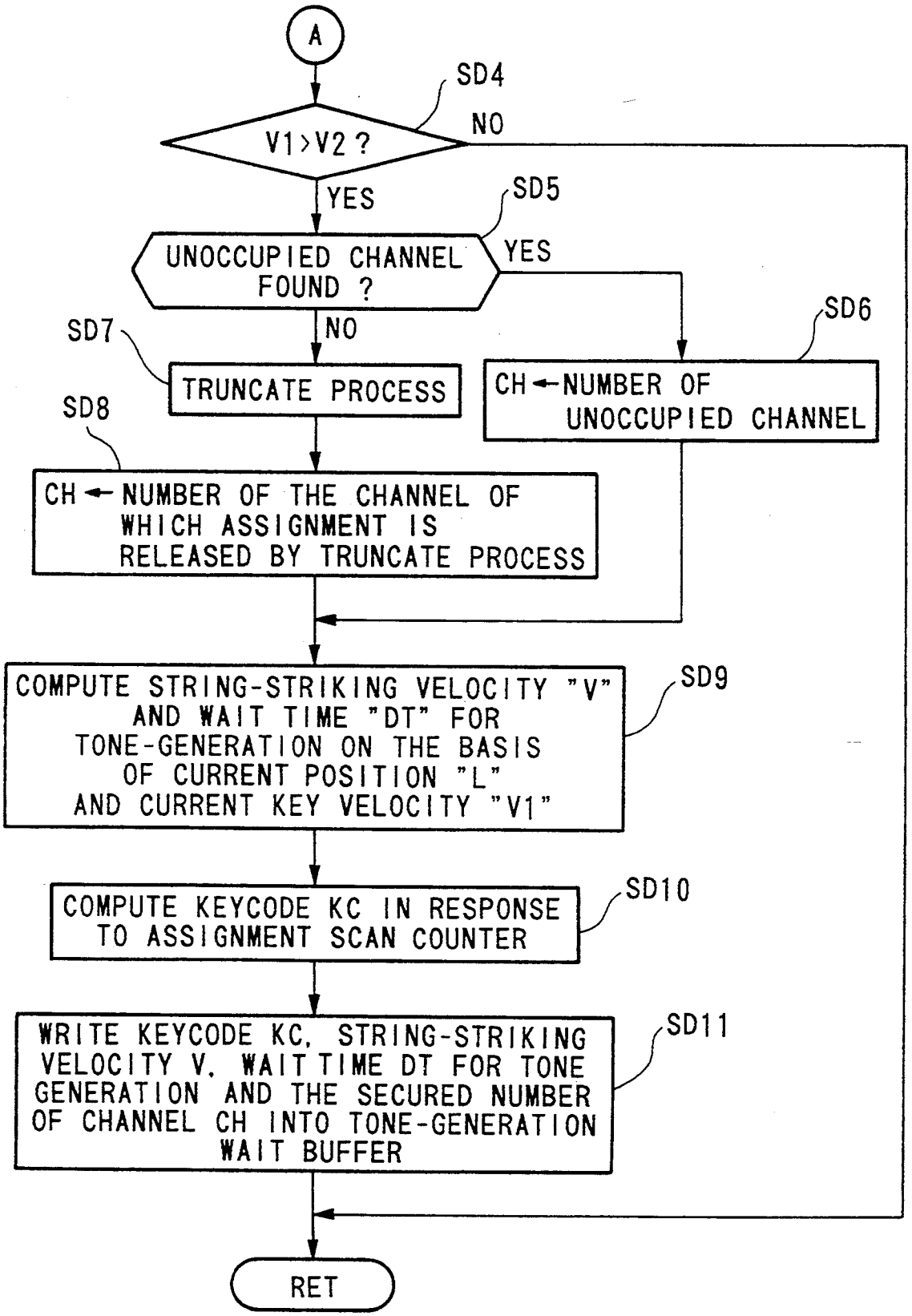

When the processing of the CPU 1 proceeds to step SC4 shown in FIG. 4, the new assignment process as shown in FIGS. 5 and 6 is started. Firstly, the processing proceeds to step SD1 shown in FIG. 5, wherein the CPU 1 reads out the information representing the preceding position of the key and the current position of the key from the storage area of the RAM 4 which corresponds to the count value of the assignment scan counter. Then, the processing proceeds to step SD2.

In step SD2, a key-operating velocity V1 at a current timing is computed on the basis of the read information representing the preceding position of the key and the current position of the key. In addition, the current position of the key is set as position data L. Then, the processing proceeds to step SD3. Incidentally, the above-mentioned key-operating velocity V1 can be easily calculated by use of a difference between the preceding position of the key and the current position of the key if the routine of the new assignment process is periodically activated. However, if the routine of the new assignment process is not activated periodically, it is necessary to measure the period of time between a preceding execution-start timing and a current execution-start timing at which this routine is started.

The present embodiment provides a position/critical-velocity table which stores a critical velocity of the key to be operated with respect to each of the depressed positions of the key. In step SD3, a critical velocity V2 corresponding to the computed position data L is read from the position/critical-velocity table. Herein, the critical velocity can be defined as a critical value for the key-operating velocity (or a minimum key-operating velocity). When the key is operated (i.e., depressed), the virtual hammer is indirectly driven. However, even if the depressing force is once applied to the key at a current moment but no additional force is applied to the key at the next moment, the virtual hammer is continuously moved toward the string by its inertia so that the virtual hammer will reach the Virtual string-striking point. In this case, it is possible to set a minimum velocity, corresponding to the key-depressing force, by which the hammer will reach the string-striking point. This minimum velocity is called as the critical velocity of the key to be operated. So, this critical velocity can be set with respect to each of the depressed positions of the key. If the actual key-operating velocity is smaller than the critical velocity at a certain depressed position of the key, the hammer does not reach the string-striking point so that the hammer will not strike the string. On the other hand, if the actual key-operating velocity is equal to or larger than the critical velocity at a certain depressed position of the key, the hammer can reach the string-striking point so that the hammer will strike the string.

As described above, a predetermined relationship is established between the depressed position of the key and the critical velocity of the key. Therefore, such relationship can be obtained through some experiments in advance. Thus, the foregoing table stores experimental values for the depressed position of the key and the critical velocity of the key. Or, if a certain function representing such relationship can be found, it is possible to store the values, which are obtained by the function, in the table.

After completing the process of step SD3, the processing proceeds to step SD4 shown in FIG. 6.

In step SD4, it is Judged whether or not the actual key-operating velocity "V1" is larger than the critical velocity "V2". Herein, the judgement result "NO" of step SD4 can be translated into the following cases: a first case where the performer slightly depresses the key but stops depressing the key; a second case where the performer mistakenly touches the key located adjacent to the key which the performer intends to depress; and a third case where the performer actually starts to depress the key but the key-depressing velocity V1 does not reach the critical velocity V2. In such cases, the processing jumps back to the foregoing tone-generation assignment process (see FIG. 4, step SC6) without substantially performing the processes of steps SD5 through SD11.

On the other hand, if the judgement result of step SD4 is "YES", representing that the actual key-operating velocity V1 is larger than the critical velocity V2 corresponding to the currently depressed position of the key, the processing proceeds to step SD5.

In step SD5, it is judged whether or not there exist an unoccupied channel among the channels provided in the musical tone synthesizing circuit 9. This unoccupied channel is now waiting for receiving a tone-generation task to be given from the CPU 1, so that a new tone-generation task can be assigned to this unoccupied channel. If the judgement result of step SD5 is "YES", the processing proceeds to step SD6.

In step SD6, the number of the unoccupied channel which is detected in the foregoing step SD5 is set to a register CH. Then, the processing jumps to step SD9.

On the other hand, if the Judgement result of step SD5 is "NO", representing that an unoccupied channel is not existed in the channels provided in the musical tone synthesizing circuit 9, the processing branches to step SD7.

In step SD7, the truncate process is carried out so as to detect the channel of which tone-volume level is attenuated and the smallest among all of the channels of the musical tone synthesizing circuit 9. Then, the processing proceeds to step SD5.

In step SD5, the number of the channel which is detected by the truncate process in step SD7 and set as the unoccupied channel is set to the register CH. Then, the processing proceeds to step SD9.

In step SD9, a string-striking velocity V and a tone-generation wait time DT are computed on the basis of the current depressed position L and the current velocity V1 with respect to the operating key. The tone-generation wait time DT is calculated on the basis of the current position L of the key and the key-operating velocity V which is detected when the depressed position of the key reaches the current position L. In other words, the tone-generation wait time DT can be defined as the period of time by which the virtual hammer reaches the virtual string-striking point from the current position of the virtual hammer corresponding to the current depressed position L of the key. Further, the string-striking velocity V can be defined as the moving velocity of the virtual hammer at a moment when the virtual hammer just reaches the virtual string-striking point. In other words, the velocity V is the actual string-striking velocity of the virtual hammer which strikes the virtual string.

There is established a predetermined relationship among the current key-depressed position L, current key-operating velocity V1, string-striking velocity V and tone-generation wait time DT. By inputting the current key-depressed position L and the current key-operating velocity V1 into an equation representing the above-mentioned relationship, it is possible to compute the string-striking velocity V and tone-generation wait time DT.

The reason why the tone-generation wait time DT is computed is to prevent a timing shift from being occurred between a key-operating time and a tone-generating time. More specifically, if the musical tone is generated simultaneously with securing the tone-generation channel, the musical tone must be generated before the moving position of the virtual hammer reaches the string-striking point. In such an event, the timing when actually generating the musical tone must be deviated (or shifted) from the timing when the performer operates the key. The reason why the string-striking velocity V is computed is that the key-depressing velocity unnecessarily matches with the moving velocity of the hammer in the real piano. In the real piano, the tone volume of the musical tone depends on the string-striking velocity of the hammer, however, in some cases, the key depressing velocity may not accurately match with the moving velocity of the hammer due to the effect of the mechanism of the hammer and the gravity applied to the hammer. After completing the process of step SD9, the processing proceeds to step SD10.

In step SD10, a keycode KC is obtained in response to the count value of the assignment scan counter. Then, the processing proceeds to step SD11.

In step SD11, the keycode KC (which is obtained by the process of step SD10), the string-striking velocity V and tone-generation wait time DT (which are obtained by the process of step SD9) and the number of the unoccupied channel (which is secured by the process of step SD6 or SD8 and its number is set in the register CH) are written into the tone-generation wait buffer which is secured in the RAM 4. Thereafter, the processing returns back to the foregoing tone-generation assignment process shown in FIG. 4, wherein the processing proceeds to step SC6. Incidentally, once the unoccupied channel is secured by the process of step SD6 or SD8 and used in the process of step SD11, this channel is not subjected to the truncate process afterward.

(5) Tone-Generation Process

Next, the tone-generation process will be described in detail.

Figure 7:
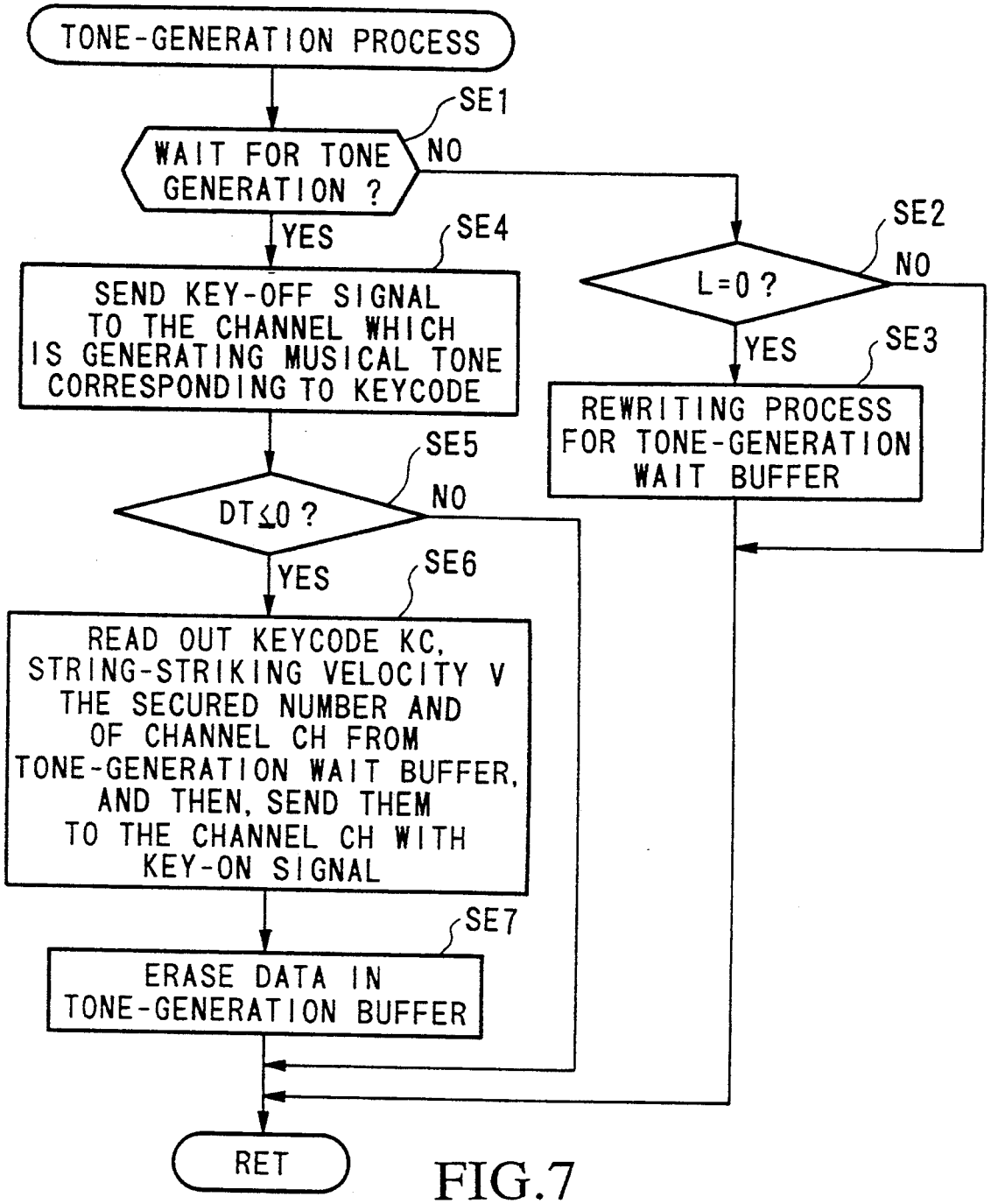
FIG. 7 is a flowchart showing a routine of a tone-generation process.

When the processing of the CPU 1 proceeds to step SC5 shown in FIG. 4, a routine of the tone-generation process as shown in FIG. 7 is started. Firstly, the processing proceeds to step SE1 wherein it is judged whether or not a tone-generation wait event is occurred with respect to the scanned key. In this event, the scanned key is discriminated as the operating key, while a tone-generation task for this operating key has been already assigned to the channel of the musical tone synthesizing circuit 9, so that tone-generation information is determined, however, the channel waits for a tone-generation instruction to be given from the CPU 1. If the judgement result of step SE1 is "NO", representing that the musical tone corresponding to the operating key is now generated from the sound system 10, the processing proceeds to step SE2.

In step SE2, it is judged whether or not the current key-depressed position L of the operating key is represented by a value "0". In other words, it is Judged whether or not the key is released. If the judgement result of step SE2 is "NO", the processing directly returns back to the foregoing tone-generation assignment process shown in FIG. 4 without substantially performing processes of this routine, wherein the processing proceeds to step SC6.

On the other hand, if the judgement result of step SE2 is "YES", representing that the key is released so that its current key-depressed position L is represented by a value "0", the processing proceeds to step SE3.

In step SE3, a key-off signal is sent to the channel which functions to generate the musical tone having the keycode KC of the operating key. Then, the processing returns back to the foregoing tone-generation assignment process shown in FIG. 4, wherein the processing proceeds to step SC6.

In the case where the judgement result of step SE1 is "YES", the scanned key is discriminated as the operating key; a tone-generation task for this key has been already assigned to one of the channels provided in the musical tone synthesizing circuit 9; but the channel waits for a tone-generation instruction to be given from the CPU 1 so that the channel is in a tone-generation wait event. In this case, the processing branches to step SE4.

In step SE4, the data which are written in the tone-generation wait buffer secured in the RAM 4 are rewritten by new data. The reason why the process of step SE4 is carried out is described below.

In the aforementioned new assignment process, the data are written into the tone-generation wait buffer only when the key-operating velocity V1 exceeds the critical velocity V2. Therefore, if the performer further applies an intense depressing force to the key after the key-operating velocity V1 exceeds the critical velocity V2, the tone-generation wait time DT must become shorter. Such event is equivalent to an event in which the string-striking velocity V becomes faster. As a result, the musical tone corresponding to that key must be produced at an earlier timing and by an intenser tone volume. In such case, however, if the data written in the tone-generation wait buffer is not rewritten responsive to an event in which an intense depressing force is further applied to the key after the key-operating velocity V1 exceeds the critical velocity V2, the musical tone must be produced based on the data which have been written in the tone-generation wait buffer. And, this musical tone does not reflect the aforementioned event, because the data of the tone-generation wait buffer does not reflect the aforementioned event. In short, the musical tone to be produced must be somewhat different from a musical tone which the performer intends to produce by further applying an intense depressing force to the key. In order to avoid such difference, the process of step SE4 is carried out, so that the data of the tone-generation wait buffer is rewritten. Due to the rewriting process of step SE4, it is possible to accurately produce a musical tone which corresponds to the operation applied to the key by the performer even if the performer alters a depressing manner of the key.

The data to be rewritten are the string-striking velocity V and the tone-generation wait time DT. As similar to the foregoing processes of steps SD9 through SD11 (see FIG. 6), the string-striking velocity V and the tone-generation wait time DT are computed on the basis of the current key-depressed position L and the current key-operating velocity V1, and then, a keycode KC is obtained in response to the count value of the assignment scan counter, and consequently, the data which have been written in the tone-generation wait buffer is rewritten by these data. Then, the processing proceeds to step SE5.

In step SE5, it is judged whether or not the tone-generation wait time DT is equal to or lower than a value "0". If the judgement result of step SE5 is "NO", the processing of the CPU 1 directly returns back to the foregoing routine of the tone-generation assignment process as shown in FIG. 4, wherein the processing proceeds to step SC6.

Each of the tone-generation wait times DT which are written in the tone-generation wait buffer is decremented by one by every period of the predetermined cycle in which a timer interrupt process (of which description is omitted) is carried out.

By repeatedly performing the timer interrupt process, a certain tone-generation wait time DT becomes equal to "0" as a result of decrementing the tone-generation wait time DT. Thereafter, when the main routine and the routine of the tone-generation assignment process is once carried out so that the processing proceeds to step SE5 again, the judgement result of step SE5 turns to "YES" so that the processing proceeds to step SE6.

At a time when the processing proceeds to step SE6, the tone-generation wait time DT has been passed away so that a timing to produce the musical tone is coming. Thus, the CPU 1 sends a tone-generation instruction to the channel which is secured in advance in the tone-generation synthesizing circuit 9. Upon the receipt of the tone-generation instruction, the keycode KC, the string-striking velocity V and the value of the register CH representing the secured channel are read from the tone-generation wait buffer, and then, they are sent to the secured channel with a key-on signal. Thus, the musical tone signal corresponding to the information stored in the tone-generation wait buffer is produced from the secured channel. Thereafter, the processing proceeds to step SE7.

In step SE7, several kinds of data which are read from the tone-generation wait buffer in step SE6 are erased from the tone-generation wait buffer. Thereafter, the processing returns back to the routine of the tone-generation assignment process, wherein the processing proceeds to step SC6.

[D] Modifications

In the embodiment described heretofore, the data of the tone-generation wait buffer are rewritten in step SE4 of the routine of the tone-generation process as shown in FIG. 7. This rewriting process is provided under the consideration of the special cases in which after the performer depresses the key, the performer further depresses the key intensely, for example. Thus, this rewriting process can be omitted in the normal case. Even in this normal case, the features of the present invention can be achieved well, in other words, the execution of the unnecessary tone-generation assignment process can be avoided, while the tone-generation assignment can be carried out in advance so that any time lag is not caused when producing the musical tone after depressing the key.

The embodiment is designed to simulate the string-striking mechanism of the non-electronic musical instrument such as the piano. However, the fundamental concept of the present invention can be applied to the general-use electronic musical instrument because the inertia affects the motion of the key of the electronic musical instrument. In short, a broad application can be considered with respect to the present invention.

In the embodiment, the routine of the tone-generation process as shown in FIG. 7 is designed such that only when a certain channel of the musical tone synthesizing circuit 9 is discriminated as a channel which waits for the tone-generation instruction, several kinds of data representing the keycode KC, string-striking velocity V and the like are sent to the certain channel (see step SE6). However, the scope of the present invention is not limited by the embodiment, so that the embodiment can be modified as described below.

Instead of writing the data in the tone-generation wait buffer in step SD11 in the routine of the new assignment process as shown in FIG. 5, the data are transferred to the secured channel in advance, and then, a key-on signal is only sent to the channel in step SE6 in the routine of the tone-generation process shown in FIG. 7. Thus, it is possible to reduce a data transfer time, by which the musical tone can be produced at a good timing in a real-time manner.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. An electronic musical instrument comprising:

a plurality of keys;

a key displacement detecting means for detecting a key displacement with respect to each of said plurality of keys;

a key-operating velocity creating means for creating a key-operating velocity on the basis of a detected key displacement with respect to each of said keys;

a comparing means for comparing whether or not said key-operating velocity is larger than a key-operating velocity value which is predetermined based on the detected key displacement;

a musical tone producing means providing a plurality of channels each capable of producing a musical tone signal;

an assignment means for assigning a tone-generation task to generate the musical tone signal corresponding to a new key-operation event to one of said channels which is selected on the basis of a result of a comparing operation carried out by said comparing means; and a control means for designating a start timing to produce the musical tone signal on the basis of said key-operating velocity and the result of the comparing operation with respect to the key in which the key-operation event has occurred.

2. An electronic musical instrument as defined in claim 1 wherein a current depressed position of the key is obtained from an output of said key displacement detecting means, while a critical velocity is determined in advance with respect to each of depressed positions of the key, so that only when said key-operating velocity exceeds said critical velocity corresponding to the current depressed position of the key, said control means designates the start timing to produce the musical tone signal from the channel.

3. An electronic musical instrument as defined in claim 1 wherein a current depressed position of the key is obtained from an output of said key displacement detecting means, while a critical velocity is determined in advance with respect to each of depressed positions of the key, so that only when said key-operating velocity exceeds said critical velocity corresponding to the current depressed position of the key, one of the channels is secured and assigned with the tone-generation task of the key.

4. An electronic musical instrument as defined in claim 1 wherein a current depressed position of the key is obtained from an output of said key displacement detecting means, while a critical velocity is determined in advance with respect to each of depressed positions of the key, so that only when said key-operating velocity exceeds said critical velocity corresponding to the current depressed position of the key, one of the channels is secured and a tone-generation wait time representing a period of time between a tone-generation timing and a current timing is set in response to the current depressed position of the key and said key-operating velocity of the key.

5. In an electronic musical instrument providing a mechanism to detect a depressed position and a key-operating velocity with respect to each of a plurality of keys of a keyboard and also providing a plurality of channels each capable of producing a musical tone signal responsive to a key-operation event on each of said plurality of keys, said electronic musical instrument comprising:

a selecting means for selecting one of said channels in accordance with a predetermined algorithm when a new key-operation event has occurred;

an assigning means for assigning a tone-generation task to produce the musical tone signal corresponding to the new key-operation event to a selected channel; and a control means for controlling an assigning operation of said assigning means in response to the current depressed position of the key and the key-operating velocity of the key.

6. An electronic musical instrument comprising:

a plurality of keys;

a key operation detecting means for detecting a current depressed position and a key-operating velocity with respect to the key on which a key-operation event has occurred;

a memory means for storing a critical velocity with respect to each of depressed positions of the key, said critical velocity representing a minimum velocity by which a hammer can strike a string when the hammer moves from a position corresponding to each of the depressed positions of the key;

a comparing means for comparing whether or not said key-operating velocity is larger than said critical velocity value which is predetermined based on the detected key displacement;

a musical tone producing means providing a plurality of channels each capable of producing a musical tone signal;

a selecting means for selecting one of the channels in accordance with a predetermined algorithm on the basis of a result of a comparing operation of said comparing means when the key-operation event has occurred;

an assigning means for assigning a tone-generation task to generate the musical tone signal corresponding to the key-operation event to a selected channel; and a control means for designating a start timing to produce the musical tone signal on the basis of said key-operating velocity and the result of the comparing operation with respect to the key on which the key-operation event has occurred.

7. An electronic musical instrument comprising:

a plurality of keys;

a key displacement detecting means for detecting a key displacement with respect to each of said plurality of keys;

a key-operating velocity creating means for creating a key-operating velocity on the basis of a detected key displacement with respect to each of said keys;

a comparing means for comparing whether or not said key-operating velocity is larger than a critical velocity value which is predetermined based on the detected key displacement;

a musical tone producing means providing a plurality of channels each capable of producing a musical tone signal; and an assignment means for assigning a tone-generation task to generate the musical tone signal corresponding to a new key-operation event to one of said channels which is selected on the basis of a result of a comparing operation carried out by said comparing means.

* * * * *